United States Patent [19]

Ueda et al.

[11] 4,314,694

[45] Feb. 9, 1982

[54] METHOD FOR CONTROLLING EXHAUST GASES IN OXYGEN BLOWN CONVERTER

[75] Inventors: Yuziro Ueda; Toru Yoshida, both of Sakai; Michiyasu Honda, Chihayaakasaka, all of Japan

[73] Assignee: Nippon Steel Corporation, Tokyo, Japan

[21] Appl. No.: 92,361

[22] Filed: Nov. 8, 1979

Related U.S. Application Data

[63] Continuation of Ser. No. 752,288, Dec. 20, 1976, Pat. No. 4,192,486.

[51] Int. Cl.[3] ..... C21B 7/22

[52] U.S. Cl. ..... 266/44; 75/60; 266/158

[58] Field of Search ..... 266/44, 158; 75/60

[56] References Cited

U.S. PATENT DOCUMENTS

| | | | |
|---|---|---|---|
| 3,559,970 | 2/1971 | Hamabe | 266/158 |
| 3,599,949 | 8/1971 | Grenfell | 75/60 |
| 4,150,973 | 4/1979 | Sanuki | 75/60 |

*Primary Examiner*—P. D. Rosenberg

[57] ABSTRACT

A method for recovering unburnt exhaust gases in an oxygen converter, characterized by the control of an exhaust gas damper by a control signal obtained by signal-processing, in accordance with the set functional formulae, an exhaust gas damper control signal obtained from a pressure differential between throat pressure and atmospheric pressure, and an exhaust gas damper prediction control signal obtained by continuously detecting the quantity of oxygen fed, the quantity of secondary raw material charged, the composition of exhaust gases and the flow rate of exhaust gases to calculate the quantity of furnace generated gases and the quantity of combustion exhaust gases at throat.

1 Claim, 12 Drawing Figures

METHOD FOR CONTROLLING EXHAUST GASES IN OXYGEN BLOWN CONVERTER

This is a continuation of application Ser. No. 752,288, filed Dec. 20, 1976, now U.S. Pat. No. 4,192,486.

BACKGROUND OF THE INVENTION

This invention relates to a method for controlling exhaust gases in an oxygen blown converter.

In steel making in a converter using oxygen, as is known, a method has been employed to recover combustible gases, such as carbon monoxide (CO) produced by blast refining, in a state unburnt for re-use as the heat source.

The unburnt gases have been recovered by employment of a method in which the pressure differential between throat pressure i.e. the pressure within the hood, and atmospheric pressure is detected, and an exhaust gas damper is automatically adjusted through an adjusting meter or regulator so that said pressure differential assumes a predetermined value. This method, however, unavoidably poses problems such as so-called blow-out, in which the exhaust gases are emitted out of the throat, and so-called intake phenomenon, in which surplus air is sucked into the throat, due to delay in detection or transmission of signals to rapid variation in quantity of exhaust gases and delay in response of the adjusting meter or the exhaust gas damper produced when the quantity or flow rate of oxygen fed is changed, when secondary material such as iron ore etc. is charged or completed to be charged, or when the quantity or feeding rate of secondary raw material charged is changed in the case where the absolute quantity of the charge is changed. This results in a waste of unburnt exhaust gases and a considerable economical loss due to wasteful burning of the exhaust gases resulting from intake of surplus air.

Thus, in the oxygen blown converter, the method has been employed in an effort to recover the combustible gases, such as CO produced in connection with the blast refining, in a state unburnt, the method normally being called the method for recovering unburnt exhaust gases. For example, see British Pat. No. 1,187,530. A method as controlling means therefore, which is generally called the throat pressure control, is used in which the pressure differential between throat pressure, i.e., the pressure within the hood is detected, and atmospheric pressure. A damper is controlled through a control means so that said internal pressure assumes a predetermined level.

Incidentally, a method is employed to suck surplus air by suitably opening the dust collector damper in order to avoid the surging phenomenon of the draught fan for the exhaust gases despite the fact that the furnace generated gases are in a very small amount at the early stage and at the last stage of blast refining in the converter. This method, however, results in a wasteful burning of unburnt gases, leading to a considerable economical loss.

Further, the aforementioned throat pressure controlling method unavoidably involves delay in detection or transmission of signals and delay in response of control means or damper drive means to repid change in converter reaction thereby inevitably producing phenomenon (blow-out phenomenon), in which the combustible gases are emitted out of the throat, or phenomenon (excessive intake phenomenon), in which surplus air is sucked into the throat, often resulting in an economical loss such as dissipation or wasteful burning of the combustible gases. In addition, the blow-out phenomenon is caused to produce emission of red fume, which is not desirable in terms of environmental health.

SUMMARY OF THE INVENTION

It is an object of the present invention to provide a method for recovering the unburnt exhaust gases without suffering from the blow-out or intake as previously mentioned, and to provide a method which has much adaptability to operating conditions and equipment conditions.

Another object of the invention is to provide a method for controlling exhaust gases without suffering from the blow-out phenomenon or intake phenomenon in recovery of unburnt exhaust gases.

A further object of the invention is to enhance recovery rate of exhaust gases and to reduce cost.

Therefore, according to one feature of the present invention, there is provided a method of controlling exhaust gases in an oxygen blown converter, characterized by predicting the quantity of furnace generated gases and varying the quantity of drawn exhaust gases.

DETAILED DESCRIPTION OF THE EMBODIMENTS

Figure 1:
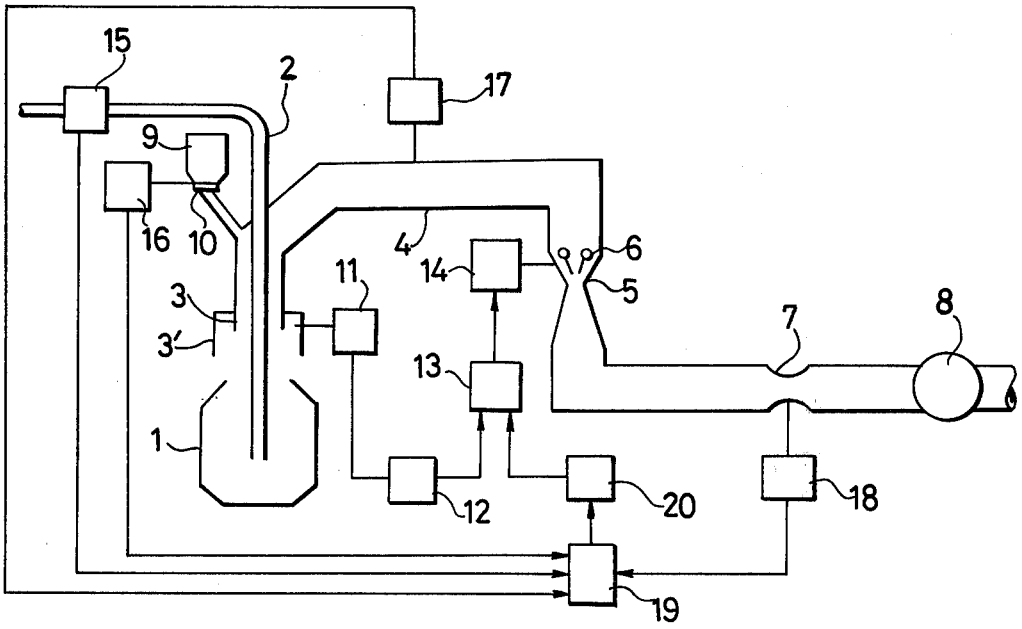
FIG. 1 is a schematic block diagram of apparatus for embodying the method of the present invention.

Referring now to FIG. 1, the reference numeral 1 designates a converter, the oxygen being introduced into steel bath by means of the blast refining oxygen lance 2. The exhaust gases produced from this converter 1 are passed through a collecting hood 3 provided with a vertically movable skirt 3' and an exhaust gas pipe 4 and are guided into a holder (not shown) or a smokestack (not shown) via a dust collector 5, an exhaust gas damper 6, a throat 7 provided with a flow detector, and a draught fan 8. The exhaust gas damper 6 employed could be any convenient design as long as it is possible to control a quantity of flow. Secondary raw material, which may include fluxes and coolants are charged into the converter 1 from a secondary raw material hopper 9 through a charging feeder 10. The pressure differential between pressure in the hood or throat pressure and atmospheric pressure is measured by a pressure differential oscillator or regulator 11, the signal thereof being supplied to a throat pressure controlling adjusting-meter or regulator 12. This adjusting meter or controller 12 has the intended pressure differential set value preset thereto, and from this, the input signal of the aforesaid pressure differential oscillator or transmitter 11 can be compared with the aforesaid pressure differential set value so that the resultant corrected signal is transmitted in the form of an exhaust gas damper control signal through a signal processor circuit 13 (later described) to a servomechanism 14 for operating the damper 6 in accordance with the conditions (later described) to thereby control the exhaust gas damper 6.

In this case, if a correction of signal is not made by the signal processor circuit 13, the control based on the known pressure difference can naturally be attained. In accordance with the present invention, in the case where a control system based on prediction later described is not desirable or impossible to be used because of operation conditions involved or troubles in equipment, the aforesaid control based on the pressure difference, i.e., feedback control may immediately be applied to thereby afford the advantages such as readiness of the control based on the pressure differential and simplicity of maintenance. In addition, according to the invention, both the feedback control and predictive control may be carried out to thereby render highly precise control possible.

Next, an operator or calculator 19 operates operations noted below on basis of an oxygen flow meter 15, a secondary raw material charge oscillator or regulator 16, an exhaust gas analyser 17, a quantity or flow rate of oxygen fed to be measured continuously by an exhaust gas flow meter 18, a quantity of secondary raw material charged, analysed values of the exhaust gases such as CO, $CO_2O_2N_2$, $H_2$, etc., and signal inputs of the exhaust gas flow.

(1) A quantity or flow rate of gases of formation formed by reaction with oxygen supplied and the oxygen generated as a result of decomposition of charged secondary raw material.

(2) A quantity or flow rate of cracked and reacted gases resulting from decomposition of the secondary raw material.

(3) A quantity or flow rate of combustion exhaust gases at throat burned and formed by air entered from the throat.

In the present invention, the abovementioned quantity or flow rate of gases of formation and quantity or flow rate of cracked and reacted gases are referred to as "the quantity of furnace generated gases".

In the case where the quantity of oxygen fed is varied as the operation progresses, that is, when the oxygen is begun to be fed and is increased or decreased in quantity to be fed, or when the secondary raw material is begun to be charged and is varied in quantity to be charged and is changed in kind or stopped to be charged, the quantity of furnace generated gases, i.e., gases produced within the hood abruptly varies. Thus, when the exhaust gas recovery system is delayed to be controlled, as previously mentioned, blow-out or excessive intake phenomenon occurs. To prevent such a phenomenon, the quantity or flow rate of furnace generated gases and the quantity or flow rate of combustion exhaust gases at throat resulting from variation of the quantity or flow rate of oxygen fed and variation of the quantity of secondary raw material charged as described above are operated by the operator or calculator 19 by means of prediction, the result therefrom being supplied to a prediction control adjusting meter or regulator 20. This adjusting meter or regulator 20 provides a quantity of exhaust gas damper prediction control in order to adjust opening of the exhaust gas damper 6 to such a degree as not to produce the blow-out or excessive intake as described above, and the control signal is delivered to the operating servomechanism 14 through the signal processor circuit 13 later described. Accordingly, the exhaust gas damper 6 is operated to be opened or closed in response to the increase or decrease of the quantity of furnace generated gases, i.e., gases in the hood and the quantity of combustion exhaust gases at throat before these gases increase or decrease. As a consequence, the exhaust gases are properly recovered, and the pressure differential between the throat pressure, i.e., the pressure in the hood and the atmospheric pressure is also properly maintained to minimize fluctuation thereof. This will be further discussed in detail with reference to the drawings.

Figure 2:
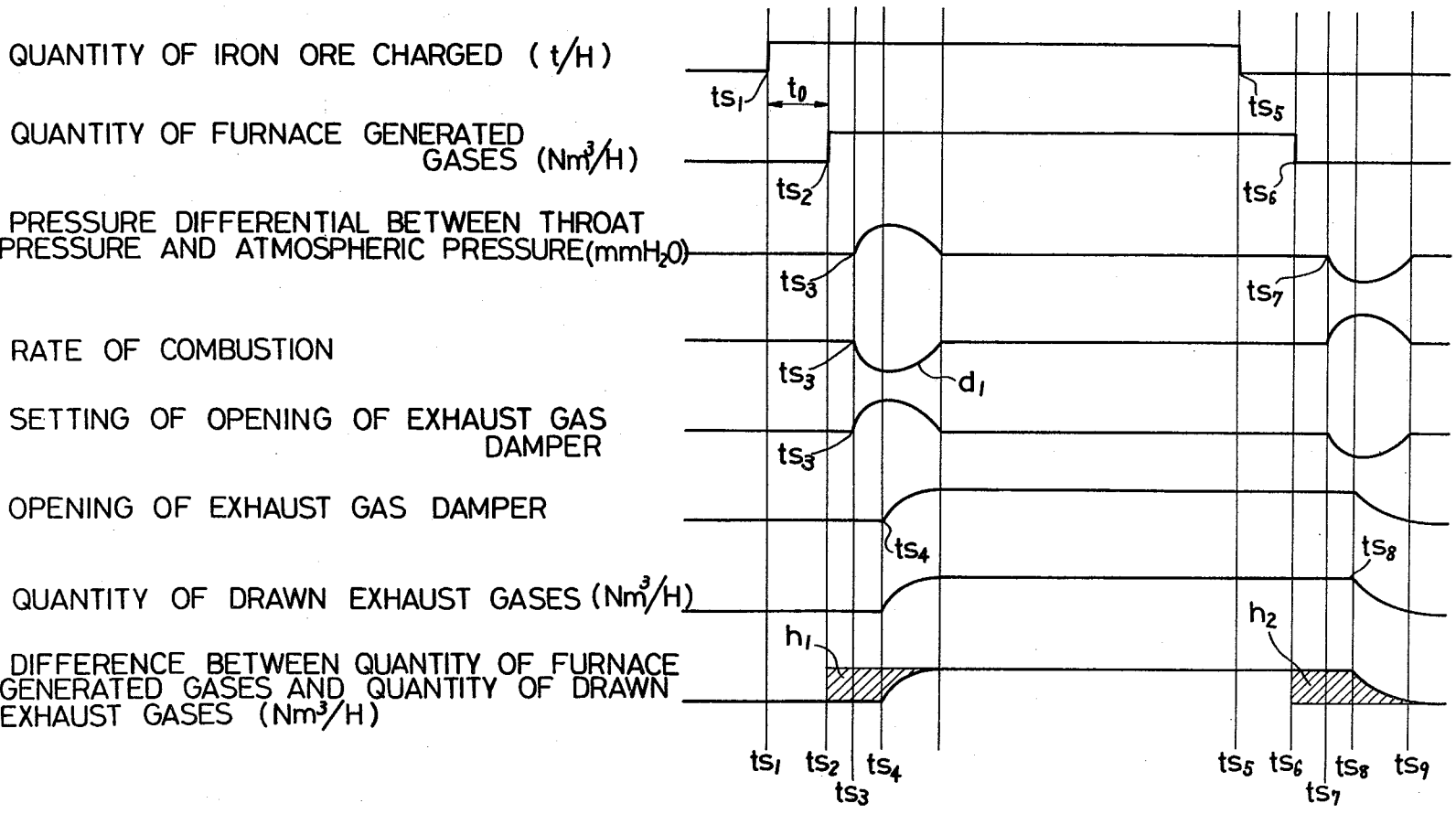
FIG. 2 schematically illustrates control of pressure differential.

FIG. 2 (*a*) to (*h*) include the axis of abscissas which represents the lapse of time, and the axis of ordinate which represents the quantity of variation with each item, showing the control based on the pressure differential between the throat pressure and the atmospheric pressure. In FIG. 2 (*a*), assuming that the iron ore as the secondary raw material is begun to be charged at time $t_{s1}$, the furnace generated gases begin to increase after the lapse of $t_0$ seconds, i.e., at time $t_{s2}$. (FIG. 2 (*b*)) Then, the pressure differential between the throat pressure and the atmospheric pressure begins to increase at time $t_{s3}$, the pressure differential being detected by the pressure differential oscillator or regulator 11. When the pressure differential increases, air entered through the throat decreases or the furnace generated gases themselves begin to give out of the skirt 3', as a consequence of which the quantity of furnace generated gases burned within the throat will decrease. That is, the quantity of CO which burns with air entered at the throat among the quantity of CO contained in the furnace generated gases increases. If the ratio of the quantity of CO in the furnace generated, i.e., gases produced in the hood to the quantity of CO which burns at the throat is expressed by the combustion rate, the combustion rate decreases as in curve $d_1$ shown in FIG. 2 (*d*). Since opening of the exhaust gas damper 6 is set at the time when an increase in the aforesaid pressure differential has been detected as shown in FIG. 2 (*e*), the exhaust gas damper 6 will not be opened until time $t_{s4}$ is reached as shown in FIG. 2 (*f*). The quantity of exhaust gases to be sucked thus begins to increase at time $t_{s4}$ as shown in FIG. 2 (*g*). As previously mentioned, however, the furnace generatd gases increases at time $t_{s2}$, and hence, the differential between the quantity or flow rate of suction exhaust gases and the quantity or flow rate of furnace generated gases, i.e., the quantity of exhaust gases corresponding to a hatched line area $h_1$ in FIG. 2 (*h*) is blown out of the throat and is dissipated outside the exhaust gas recovery system. Further, after the secondary raw material has been charged, the quantity of furnace generated gases is actually decreased at $t_{s6}$ but is delayed in response so that the exhaust gas damper 6 remains opened until time $t_{s9}$ is reached thereby allowing air corresponding in quantity to a hatched line area $h_2$ to enter through the throat. The exhaust gases are burned by the thus entered air to decrease thermal calorie of the recovered exhaust gases and to increase temperature of the exhaust gases simultaneously therewith, and as a result, extra energy is required to cool the exhaust gases and the service life of the machinery may be shortened.

Figure 3:
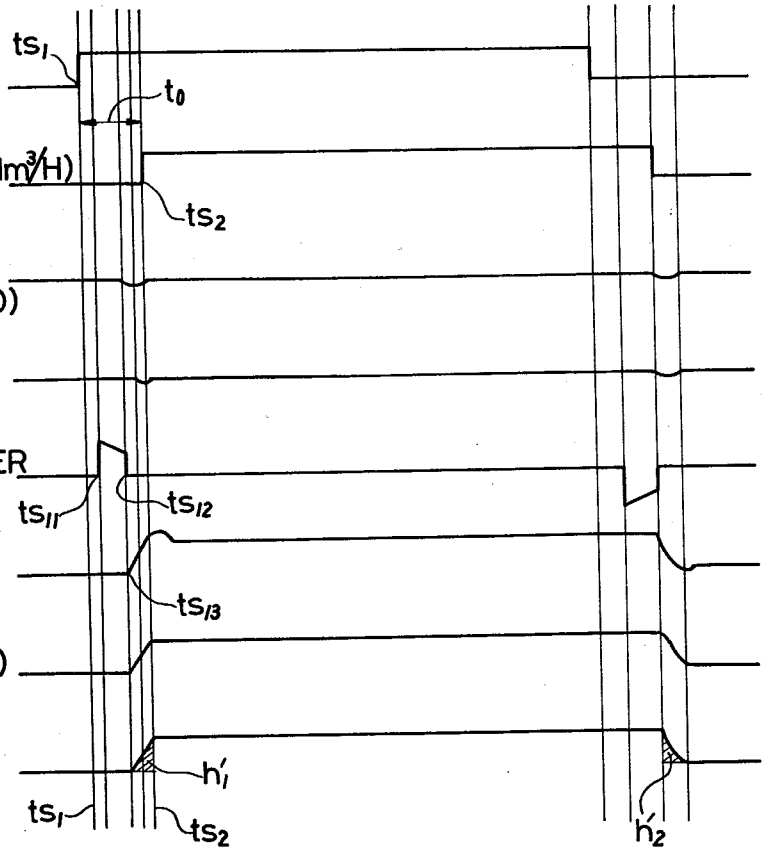
FIG. 3 schematically illustrates prediction control in accordance with the present invention.

In order to overcome the response delay as noted above, the present invention may provide a predictive control as shown in FIG. 3 (*a'*) to (*h'*). In FIG. 3 (*a'*), at ore charging time $t_{s1}$, an ore charge starting signal is received from the secondary raw material charge oscillator or regulator 16, and immediately the opening of the exhaust gas damper 6 is set through the operator or calculator 19 and the prediction control adjusting meter or regulator 20 at time between $t_{s11}$ and $t_{s12}$, the exhaust gas damper 6 being opened at time $t_{s13}$. Since time $t_{s13}$ is actually earlier than time $t_{s2}$ at which the furnace generated gases, i.e., gases generated in the hood begin to increase, the difference between the furnace generated gas quantity or flow rate and the suction exhaust gas quantity or flow rate is produced to thereby suck a small amount of air corresponding to a hatched line area h'1 as shown in FIG. 3 (*h'*). However, this is merely one example. Practically, the increase in the quantity or flow rate of furnace generated gases and adjustment of opening of the exhaust gas damper 6 may be well arranged whereby minimizing the abovementioned suction to a degree such as to be out of question in actual operation. While the abovementioned suction sometimes turns the blow-out by suitable selection of the time difference between time $t_{s13}$ and $t_{s2}$ as previously mentioned, this can be suitably selected in accordance with the equipment conditions.

It will be noted in FIG. 3 that the difference between the quantity or flow rate of furnace generated gases and the quantity or flow rate of suction exhaust gases after the secondary raw material has been charged, i.e., the quantity corresponding to a hatched line portion h'2 in FIG. 3 (*h'*) is the residual quantity or flow rate of suction air which has not been burned. It is natural in recovery of such exhaust gases that control involving neither blow-out nor excessive intake is better. However, it has a tendency to be one-sided to either mode though little depending upon equipment condition. In this case, it is better to adjust the control system relative to the intake side in terms of both operating environment and utilizing effect of exhaust gases, but this is in no way restrictive. While variation of the charging quantity of raw material has been described particularly in respect of iron ore charging in the embodiment described above, it is to be understood that also in other cases, similar procedure may be employed to achieve similar effects.

Next, a method for calculating the quantity or flow rate of combustion exhaust gases at throat to be sucked will be described in detail. Concentrations of exhaust gas analysed values CO, $CO_2$, $H_2$ and $N_2$ obtained from the exhaust gas analyser 17 are expressed by $X_{co}$, $X_{co_2}$, $X_{o_2}$, $X_{h_2}$ and $X_{n_2}$ (%), respectively. With respect to $X_{n_2}$ (%), in this case, it could be ruled that the $N_2$ is one other than CO to $H_2$. Since the gases generated within the converter comprise CO, $CO_2$ and $H_2$, it may be considered that most of $N_2$ within the exhaust gases are induced by air entered through the throat. It may also be considered that the greater part of $O_2$ contained in air entered through the throat burns with CO within the furnace generated gases and a small amount of remainder thereof is detected as $X_{o_2}$% within the exhaust gases. Accordingly, the apparent concentration $X_{o'_2}$ of the $O_2$ contained in air entered through the throat to the quantity of combustion exhaust gases at throat can be calculated by equation (1) below from the concentration of the quantity of $N_2$ contained in air entered through the throat, i.e., the concentration $X_{n_2}$% of $N_2$ within the exhaust gases, $$X_{o_2}' = \frac{21}{79} \cdot X_{n_2} \tag{1}$$

From this, the apparent concentration $X_{o''_2}$% of the quantity of $XO_2''$ connected in combustion of the furnace generated gases within the collecting hood 3 to the quantity of combustion gases at throat may be obtained by equation (2) below from the quantity of $XO_2''$ not connected in combustion, i.e., the concentration $X_{O''_2}$% of $O_2$ within the exhaust gases, $$X_{o''_2} = X_{o'_2} - X_{O''_2} \tag{2}$$

The Co within the furnace generated gases is oxidized into $CO_2$ as indicated by equation (3) below by the $O_2$ connected in combustion, $$2CO + O_2 \rightarrow 2CO_2 \tag{3}$$

Thus, the CO produced in the converter is partly oxidized by the $XO_2$-$XO_2$ within air entered through the throat into the combustion exhaust gases at throat, and as a consequence, the CO concentration decreases as compared to the furnace generated gases while the $CO_2$ concentration increases. From the foregoing, the apparent concentrations $X_{co'}$ and $X_{co'_2}$% of the quantities of CO, $CO_2$, respectively, produced within the converter to the quantity of combustion gases at throat may be obtained by equations (4) and (5), respectively, $$X_{co'} = X_{co} + 2 \cdot X_{o''_2} \tag{4}$$

$$X_{co'_2} = X_{co_2} - 2 \cdot X_{o''_2} \tag{5}$$

From this, a ratio of air entered through the throat to the quantity of burning CO, among the quantity of CO produced in the converter, i.e., the combustion rate λ may be obtained by equation (6) below, $$\lambda = (X_{co'} - X_{co}) / X'_{co} \tag{6}$$

Further, the relation of variation in volume when the furnace generated gases turns the combustion exhaust gases at the throat may be obtained by equation (7) below, from which the quantity or flow rate of combustion exhaust gases to be sucked may be calculated.

$$\frac{\text{Quantity of combustion exhaust gases}}{\text{Quantity of furnace generated gases}} = \frac{100}{(X'_{co} + X_{co_2} + X_{n_2})} \tag{7}$$

Next, the quantity of furnace generated gases, i.e., gases generated in the converter may be calculated in a manner as follows. If the total quantity of oxygen supplied to the converter 1 reacts with carbon within the steel bath as indicated by equation (8) below, the volume in quantity of gases of formation after reaction in a standard condition is twice as much as the volume of the total quantity of oxygen supplied, $$2C+O_2 \rightarrow 2CO \quad (8)$$

However, since a part of oxygen is also reacted as indicated by equation (9) below, an increase in volume of gases of formation after reaction with respect to the total quantity of supplied oxygen is reduced by a produced amount of $CO_2$, $$2CO+O_2 \rightarrow 2CO_2 \quad (9)$$

Assuming now that the apparent ratio of the quantities of CO and $CO_2$ produced in the converter to the quantity of combustion exhaust gases at throat is X'co and X'co$_2$%, respectively, as previously mentioned and a ratio of the quantity of $CO_2$ produced in the converter to the quantities of the furnace generated CO and $CO_2$ is $\gamma$%, and $\gamma$ may be obtained by equation (10) below, $$\gamma = \frac{X'co_2}{X'co + X'co_2} \times 100 \quad (10)$$

From this, the quantity or flow rate of gases of formation after reaction to the total quantity of supplied oxygen may be obtained by equation (11) below, $$\frac{\text{Quantity of gases produced within converter after reaction}}{\text{Total quantity of supplied oxygen within converter}} = \left(2 - \frac{\gamma}{100}\right) \quad (11)$$

Let $Fo_2Nm^3/Hr$ be the quantity of oxygen fed obtained from the oxygen flow meter 15, $W_1T/Hr$ the charge quantity of secondary raw material which produces $O_2$ resulting from cracking among the charge quantity of secondary raw material obtained from the secondary raw material charge oscillator or regulator 16, $\alpha_1Nm^3/T$ the coefficient of producing $O_2$, $W_2T/Hr$ the charge quantity of secondary raw material which produces cracked reaction gases resulting from cracking, and $\alpha_2Nm^3/T$ the coefficient of producing gases thereof. Then $F_1Nm^3/Hr$, the quantity of gases of formation produced resulting from reaction with oxygen within the converter, $F_2Nm^3/Hr$, the cracked reaction gases produced resulting from cracking of the secondary raw material, and $F_3Nm^3/Hr$, the quantity of furnace generated gases produced in the converter, which is the sum of $F_1Nm^3/Hr$ and $F_2Nm^3/Hr$, are given by equations (12), (13) and (14), respectively, $$F_1 = \left(2 - \frac{\gamma}{100}\right)(Fo_2 + \alpha_1 \cdot W_1) \quad (12)$$

$$F_2 = \alpha_2 \cdot W_2 \quad (13)$$

$$F_3 = F_1 + F_2 \quad (14)$$

The coefficients $\alpha_1$ and $\alpha_2$ can easily be obtained by the constituents of the respective secondary raw material. Generally, however, in the iron ore, $\alpha_1$:150 to 250 $Nm^3/T$, and in the raw dolomite, $\alpha_2$: 150 to 250 $ONm^3/T$.

Accordingly, the quantity or flow rate of combustion exhaust gases resulting from combustion at the throat to be sucked may be obtained easily by equation (7') below rather than the equation (7) described above, $$F_4 = \frac{100}{(X'co + X'co_2 + Xn_2)} \cdot F_3 \quad (7')$$

Figure 4:
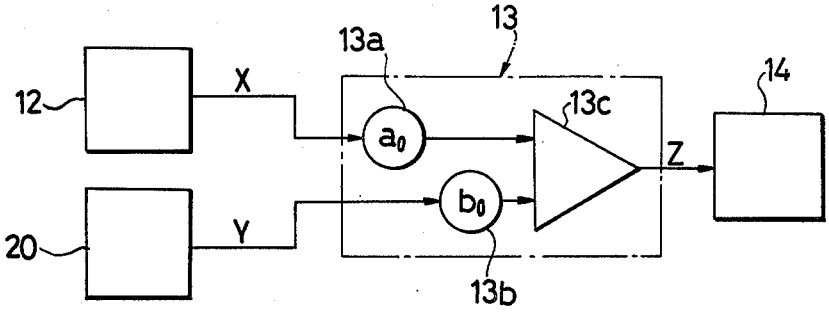
FIG. 4 schematically illustrates signal processing in a signal processing circuit in accordance with the present invention.
Figure 5:
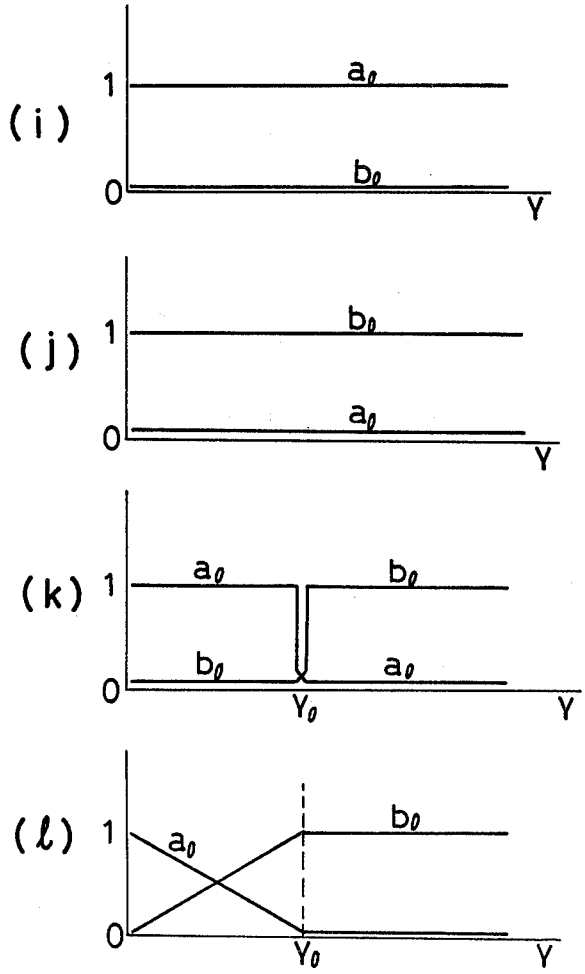
FIGS. 5 (*i*) to (*l*) schematically illustrate the coefficient of coupling.

Signal processing of the exhaust gas damper control signal based on the pressure differential between the throat pressure and the atmospheric pressure and the exhaust gas damper prediction control signal based on change in the quantity of oxygen fed and the quantity of secondary material charged in accordance with the present invention will be described in detail with reference to FIGS. 4 and 5. In FIG. 4, the control signal X of the exhaust gas damper 6 from the throat pressure controlling adjusting-meter 12 and the control signal Y from the prediction control adjusting meter 20 are supplied to the conventional type of signal processor circuit 13. As the signal processor circuit 13 which is well-known, for example, FIG. 4 shows a combination of conventional potentio meters 13*a*, 13*a* and conventional adder 13*c* for operating the processes as shown in FIG. 5 (*i*) and (*j*). In the signal processor circuit 13, the operating process, for example, based on equation (15) below is carried out to provide a control signal Z.

$$Z = a_oX + b_oY \quad (15)$$

where, $a_o$ and $b_o$ are the coefficients of coupling, respectively. In this case, only the controlling based on the pressure differential between the throat pressure and the atmospheric pressure could be employed by setting the coefficient of coupling to $$a_o=1,\ b_o=0$$

as shown in FIG. 5 (*i*) according to the equipment conditions, for example, such as troubles in apparatus, or the operating conditions, or a method relying on the quantity of the exhaust gas damper prediction control could be employed by setting the coefficient of coupling to $$a_o=0,\ b_o=1$$

as shown in FIG. 5 (*j*).

Further, in the case where the control signal is in excess of a predetermined control signal value $Y_o$ as shown in FIG. 5 (*k*), linear coupling could be employed so as to have the coefficient of coupling as shown below at that time, $$a_o=0,\ b_o=1$$

That is, the prediction control at the time of changing the aforementioned quantity or flow rate of oxygen fed and or the quantity of secondary raw material charged may easily be accomplished by selecting the set control signal value $Y_o$ so as to assume a suitable value. To achieve control with high accuracy, the coefficient of coupling $a_o$ may gradually be decreased and conversely the coefficient of coupling $b_o$ may gradually be increased until the set control signal value $Y_o$ is reached, as shown in FIG. 5 (*l*), then the coefficient of coupling are $$a_o=0,\ b_o=1$$

at the set control signal value $Y_o$.

It will be noted in the present invention that higher linear couplings or couplings with other functions may also be employed by using the equation, $Z=f(X,Y)$ though not shown. In the present invention, accomplishment of control in accordance with the signal process noted above is referred to as the control of exhaust gas damper in accordance with the control signal obtained resulting from signal processing in accordance with the set functional equation. The abovementioned signal processor circuit 13 comprises a combination of known control elements so that functional analysis in compliance with the purpose may be obtained. For example, the processes as shown in FIG. 5 (*i*) and (*j*) can be carried out by the signal processor circuit 13 of such a type as shown in FIG. 4.

The processes as shown in FIG. 5 (*k*) and (*l*) can be accomplished by the signal processor circuit of the conventional type including a comparator, functional generator etc.

Figure 6:
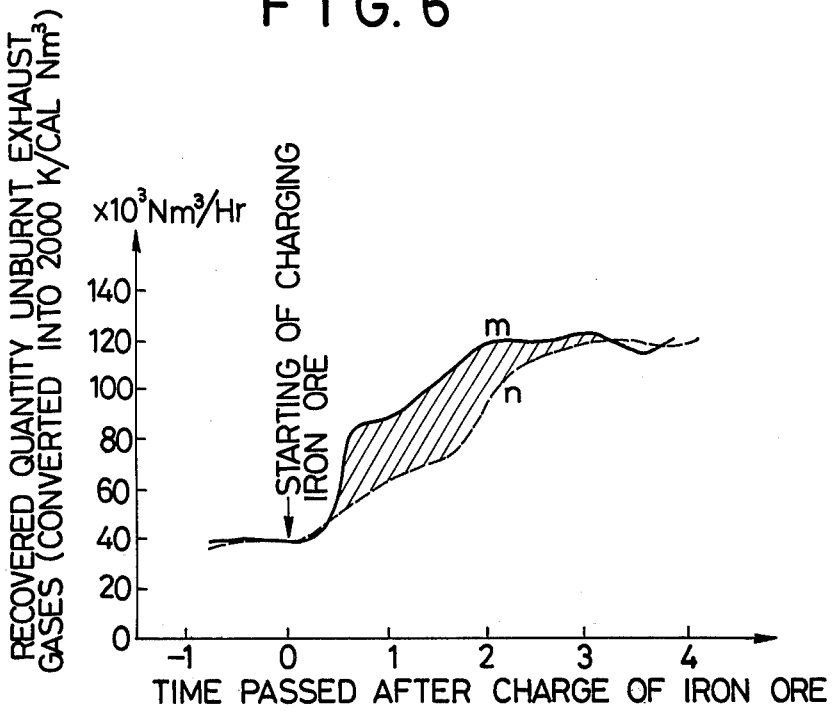
FIGS. 6 and 7 illustrate a comparison of the recovered quantity of unburnt gases between the present invention and prior art method, in connection with an embodiment of a 170-t converter in accordance with the present invention.
Figure 7:
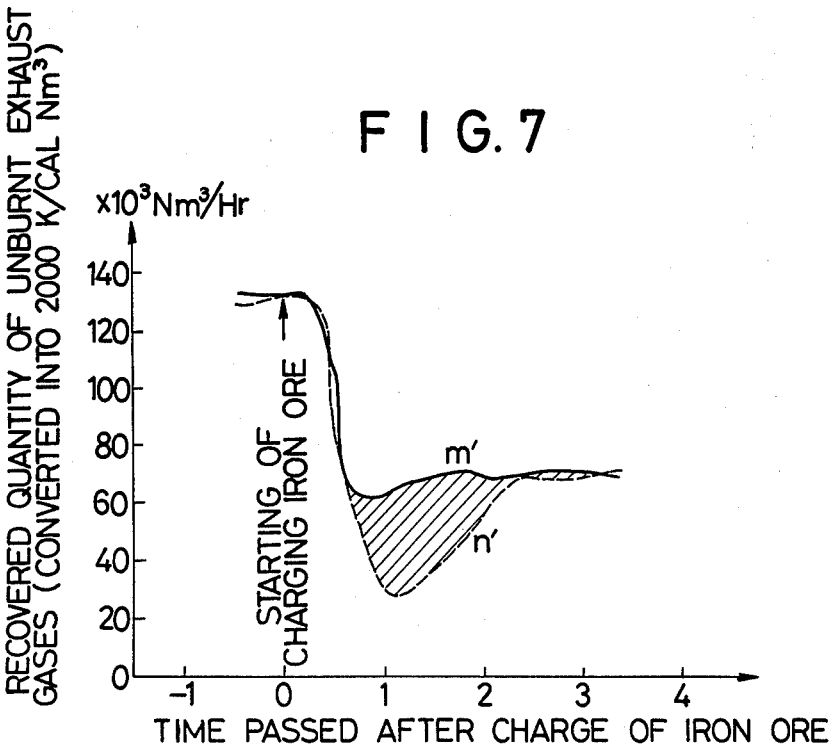

An embodiment in connection with a 170-t converter of the present invention is shown in FIGS. 6 and 7. FIG. 6 is a graphic representation, in which variation in recovered quantity of unburnt exhaust gases, which has been converted into the quantity of gases with a standard calorific power (2000 Kcal/$Nm^3$), is illustrated in accordance with time (minute) passed after commencement of charging iron ore, the solid line (m) representing the example of the present invention, the dotted line (n) the example of prior art method, and the hatched line area the example by which the recovered quantity of unburnt gases is enhanced or the gas emission from the throat is decreased, i.e., enhancement by 500 $Nm^3$ in this example. FIG. 7 is a graphic representation, in which variation in recovered quantity of unburnt gases converted into calorific power at the time of completion of charging iron ore is illustrated in accordance with time (minute) passed after completion of charging iron ore, the solid line (m') representing the example of the present invention, the dotted line (n') the example of prior art method, and the hatched line area the example by which the recovered quantity of unburnt gases is enhanced or entry of the surplus air from the throat is restrained, i.e., enhancement by 400 $Nm^3$ in this example.

Figure 8:
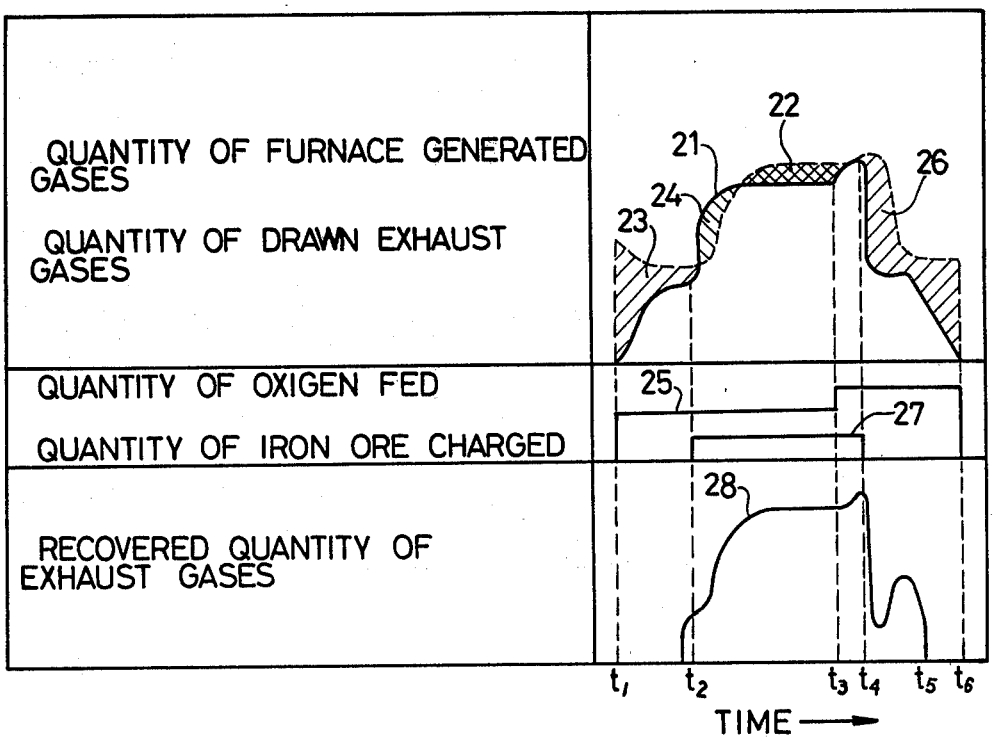
FIG. 8 illustrates variation with time in the control of throat pressure.

FIG. 8 is a schematic explanatory view of the exhaust gas recovery in the known throat pressure control, the axis of abscissa representing time while the axis of ordinate representing the quantity of furnace generated gases, the quantity of exhaust gas flow, the quantity of oxygen fed, the quantity of iron ore charged, and the recovered quantity of exhaust gases, variation thereof with time being illustrated in the form of graphs. At time $T_1$, blast refining begins, and the quantity of furnace generated gases varies with a lapse of time as shown by the solid line 21. Incidentally, since openings of the dust collector damper and draught fan damper are set greater than the quantity of furnace generated gases in fear of surging of the draught fan as previously mentioned, the suction quantity of exhaust gases varies as shown by the dotted line 22. That is, the hatched line area 23 separated from the solid line 21 and dotted line 22 means the intake of surplus air from the throat portion, and hence, at an early stage of blast refining as indicated at time $T_1$ and time $T_2$, combustible gases or CO gases are wastefully burned within a flue to fail to recover gases, and dust contained within the furnace generated gases by combustion are formed into fine particles to decrease dust collecting efficiency. Gas recovering normally begins when a content of CO in the exhaust gases reaches approximately 40%, which is determined from an economical point of view in utilization of exhaust gases. If the intake of the surplus air could be reduced, the rate of gas recovery at time $T_1$ to $T_2$ would be enhanced. Next, the furnace generated gases abruptly increase in volume as reaction in the converter violently takes place at time $T_2$. However, in the throat pressure control method, the quantity of drawn gases cannot follow an increase in quantity of furnace generated gases due to response delay of the control system, and for this reason, in the hatched line area 24, the furnace generated gases are blown out of the throat to wastefully lose CO gases leading to a loss thereof, resulting in an adverse effect also in terms of environmental health.

Next, at a middle stage of blast refining, the quantity of furnace generated gases will be stabilized and the quantity of drawn exhaust gases will also be stabilized accordingly. However, at a final stage of blast refining, when operation is made so as to increase the quantity of oxygen fed at time $T_3$ as shown by the solid line 25 for the purpose of approaching the quantity of carbon in steel to its goal, the quantity of furnace generated gases may increase for a while but abruptly decreases as the quantity of carbon in steel decreases. Also, at this time, the quantity of drawn exhaust gases cannot follow the variation in quantity of furnace generated gases due to the delay of the control system to produce the excessive intake of surplus air from the throat portion as shown by the hatched line area 26 leading to a wasteful combustion, thus giving rise to a problem entirely similar to that produced in the abovementioned hatched line area 23.

In FIG. 8, the solid line 27 indicates charging of secondary raw material or the like representative of the quantity of iron ore charged, and the solid line 28 indicates the recovered quantity of gases in standard calorific power.

The present invention may provide a control method without suffering from the difficulties noted above with respect to prior art exhaust gas controls, and principally comprises predicting the quantity of furnace generated gases as previously mentioned, and varying the quantity of drawn exhaust gases. When the quantity of furnace generated gases is expected to be increased or decreased, opening of the dust collector damper is operated beforehand so that the quantity of drawn exhaust gases may synchronously be increased or decreased in response to increase or decrease of the quantity of furnace generated gases as previously mentioned.

The method of the present invention will now be described by way of embodiment.

Figure 9:
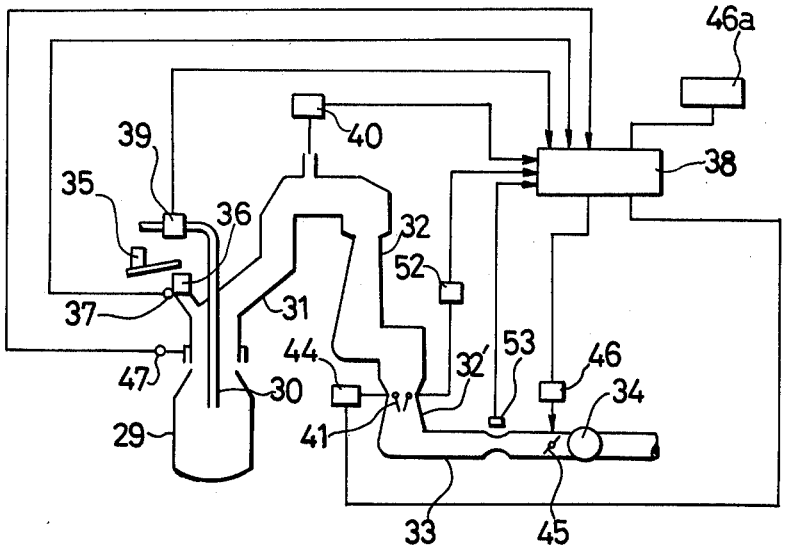
FIG. 9 is a schematic block diagram of apparatus for recovering unburnt exhaust gases in a converter.

In FIG. 9, the reference numeral 29 designates a converter, 30 an oxygen lance, 31 and 33 exhaust ducts, 32 and 32' dust collectors, and 34 a draught fan. In the blast refining, the secondary raw material is charged into the converter 29 through a charging chute 36 from the secondary raw material charging device 35, the charged quantity being applied from a secondary raw material charge oscillator 37 to an operation control device 38. The quantity of oxygen fed is applied to the operation control device 38 from an oxygen flow meter 39 and the composition of exhaust gases applied thereto from an exhaust gas analyser 40. Opening of a dust collector damper 41 (hereinafter referred to as a DC damper) disposed in the dust collectors 32 and 32' is similarly applied to the operation control device 38 from an opening oscillator 42 and the quantity of exhaust gas flow applied thereto from a flow meter 43. A DC damper 41 is operated by the operation control device 38 through a DC damper control device 44 and a draught fan damper 45 (hereinafter referred to as a SD damper) operated thereby through an SD damper control device 46. An applied information input device indicated as at 46a is provided to apply various information required to predict the quantity of furnace generated gases, for example, such as quantity of hot metal, quantity of mold metal, quantity of scrap, temperature of hot metal, content of Si, quantity of lime, throat pressure, etc. to the operation control device 38. A throat pressure oscillator indicated as at 47 is provided to similarly apply the throat pressure signal to the operation control device 38.

The method of the present invention may be carried out through the devices as just mentioned, and the quantity of furnace generated gases as the reference of control can be predicted in a manner as follows.

Concentrations of CO, $CO_2$, $O_2$, $H_2$, $N_2$ within the exhaust gases obtained from the exhaust gas analyser 40 are expressed by Xco, $Xco_2$, $Xo_2$, $Xh_2$, $Xn_2$ (%). With respect to $Xn_2$ (%), in this case, it could be ruled that the $N_2$ is one other than CO, $CO_2$, $H_2$. The gases produced in the converter comprise CO, $CO_2$ and $H_2$ and are burned with air at the throat. Then, the analysed values of exhaust gases as indicated by the concentrations Xco to $Xn_2$ (%), the exhaust gas flow value F obtained by the exhaust gas flow meter 43, the quantity of furnace generated gases, and the concentration of gases thereof may be given by equations (16) to (20).

That is, let X'co, $X'co_2$ and $X'h_2$ be the concentrations of furnace generated gases, $X'o_2$ the ratio of the quantity of oxygen from the air entered the throat to the quantity of exhaust gases, and $X''o_2$ the reaction oxygen at the throat. Then equations are $$X'o_2 = \frac{21}{79} \cdot Xn_2 \tag{16}$$

$$X''o_2 = X'o_2 - Xo_2 \tag{17}$$

$$X'co = Xco + 2 \cdot X''o_2 \tag{18}$$

$$X'co_2 = Xco_2 - 2 \cdot X''o_2 \tag{19}$$

The quantity F' of furnace generated gases is given by equation (20) below, $$F' = F \cdot (X'co + X'co_2) \tag{20}$$

The abovedescribed equations (16) to (20) are not concerned with $H_2$ gas, the $H_2$ gas being handled similarly to CO gas.

Figure 10:
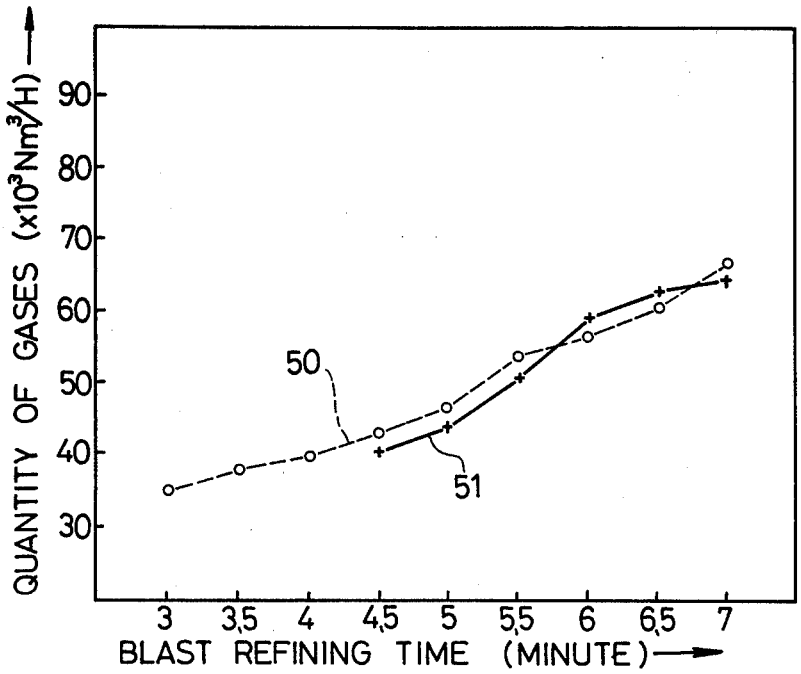
FIG. 10 is a view of assistance in explaining prediction of the quantity of furnace generated gases.

Next, prediction of the quantity F' of furnace generated gases will be described. Let F'n be the value at time tn of the quantity F' of furnace generated gases obtained by the equation (20). It is now assumed that present is expressed by n=0, time prior to present expressed by n=−1, −2 . . . , and time after a lapse of given time from present expressed by n=+1, +2 . . . The n can suitably be determined. FIG. 10 illustrates one embodiment, which predicts the quantity $F'_{+1}$ of furnace generated gases 30 seconds after the quantities $F'_{-2}$, $F'_{-1}$, $F'_0$ of furnace generated gases at three times at intervals of 30 seconds, n=−2, −1, and 0 at an early stage of decarburization reaction. In FIG. 10, curve 50 designates the dotted row of the quantity F' of furnace generated gases every 30 seconds, and curve 51 designates the dotted row of the predicted value $F'_{+1}$ of the quantity of furnace generated gases obtained by linear components from three dotted rows, $F'_{-2}$, $F'_{-1}$, and $F'_0$. As is obvious from the figure, this predicting method is very high in accuracy. It will however be noted that in order to further enhance accuracy, curve components such as a quadratic equation may also be employed or, prediction at suitable time selected out of 1 to 30 seconds instead of every 30 seconds may be accomplished.

That is, if the quantity F' of furnace generated gases is obtained, the quantity $F_{ex}$ of drawn exhaust gases can easily be obtained by equation, $$F_{ex} = K \cdot F \tag{21}$$

where K is the coefficient used to obtain the quantity of exhaust gases drawn by the draught fan from the quantity of furnace generated gases, the good result being obtained by setting the coefficient to 1.2 according to experience of the present inventor. However, the coefficient K varies with the characteristics of equipment, the range thereof being considered from 1.0 to 1.4.

Figure 11:
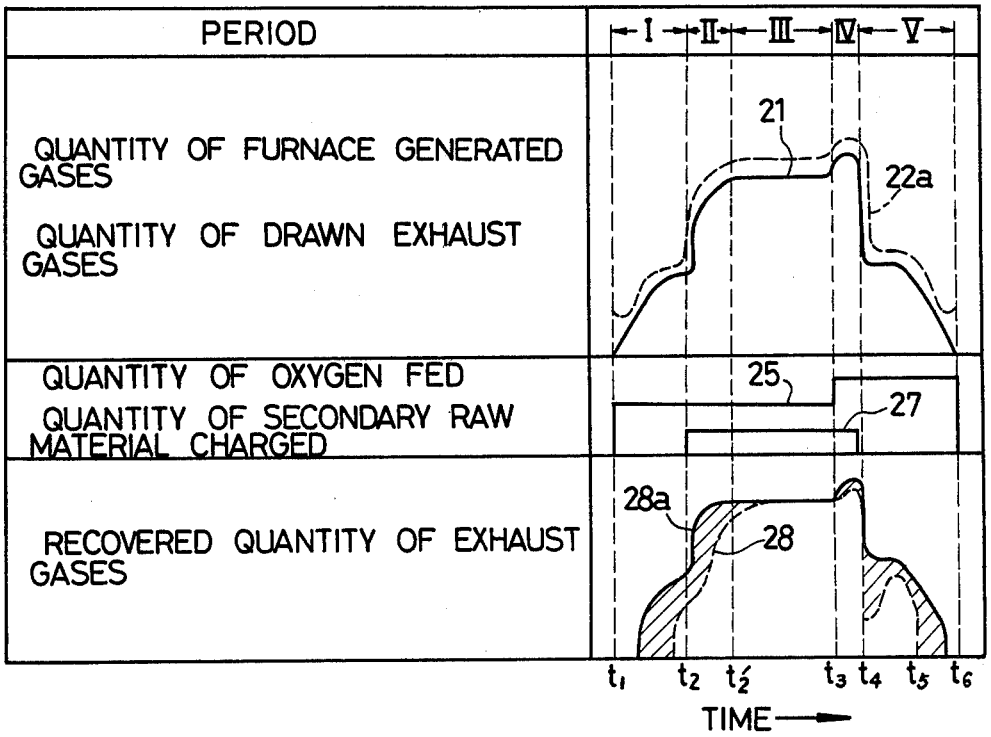
FIG. 11 illustrates variation with time of gas recovery in accordance with the controlling method of the invention.

The embodiment of the control method in accordance with the present invention will now be described with reference to graphs shown in FIGS. 11 and 12. In FIG. 11, the axis of ordinate represents the quantity of furnace generated gases 21, the quantity of drawn exhaust gases 22a in accordance with the present method, the quantity of oxygen fed 25, the quantity of other secondary raw material charged 27 including an oxidation coolant, the recovered quantity of gases 28 in standard calorific power not in accordance with the present method, and the recovered quantity of gases 28a in standard calorific power in accordance with the present method, whereas the axis of abscissa represents a lapse of time, illustrating variation thereof with time.

Next, it is assume that the step from the beginning of blast refining at time $T_1$ to charging of other secondary raw material including the oxidation coolant at time $T_2$, i.e., from desiliconizing reaction to early decarburization reaction is period I; the step from a rapid increase in the quantity of furnace generated gases to a subsequent mode of stabilization, i.e., the step of rapid increase in the quantity of gases resulting from charging of the oxidation coolant and other secondary raw material from time $T_2$ to time $T'_2$ is period II; the step of a further mode of stabilization of the quantity of furnace generated gases, i.e., the step from time $T'_2$ to time $T_3$ is period III; the step of increasing the quantity of oxygen fed to temporarily increase the quantity of furnace generated gases, i.e., the step from time $T_3$ to $T_4$ is period IV; and the step of the last stage of blast refining until oxygen feeding is stopped, i.e., time from $T_4$ to $T_6$ is period V.

During the period I, the quantity of furnace generated gases is predicted but the gases are not much produced during this period so that the quantity of drawn exhaust gases may be determined in consideration of surging of the draught fan.

Figure 12:
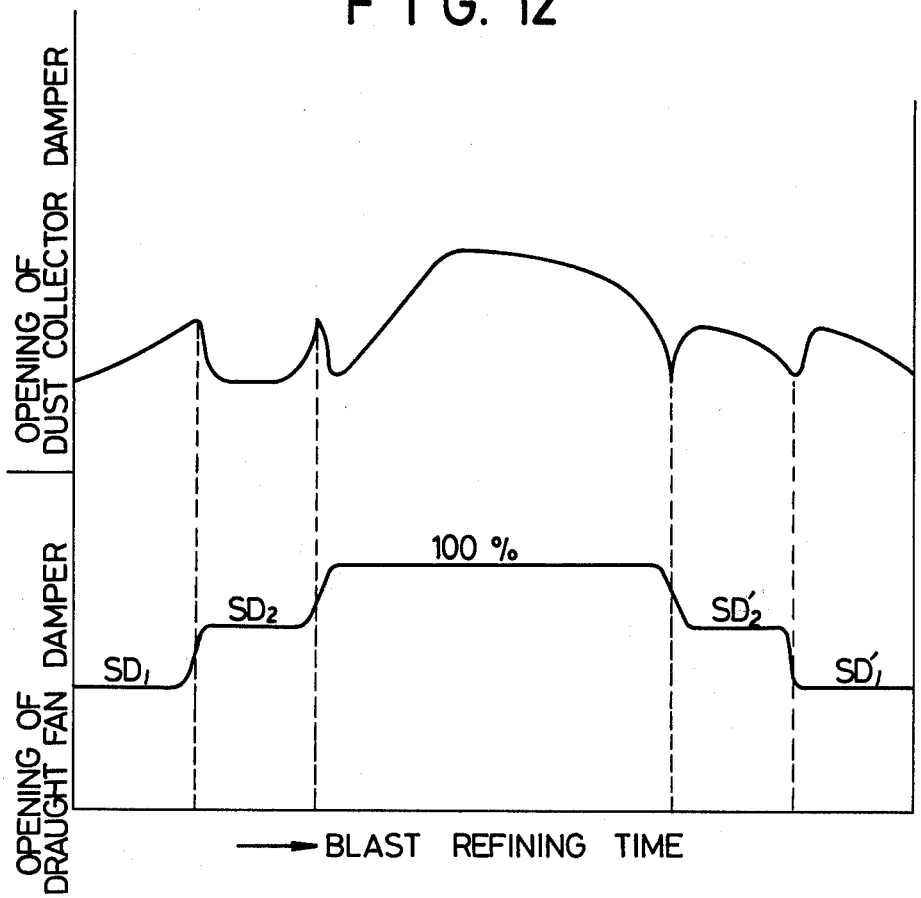
FIG. 12 is a view of assistance in explaining operation of a draught fan damper and a dust collector damper.

FIG. 12 illustrates operation of opening of the draught fan damper and the dust collector damper. That is, at the time of starting blast refining the opening of the draught fan damper is set to $SD_1$, and as the quantity of furnace generated gases increases, the opening of the dust collector damper is windened. At the time when said opending is reached a given value, the opening of the draught fan damper is reset to $SD_2$ ($SD_2 > SD_1$) and at the same time, the opening of the dust collector damper is narrowed in accordance with the required quantity of exhaust gases. This operation is repeated one or several times until the opening of the draught fan damper is 100%, then the dust collector damper is independently controlled. During the period in which the furnace generated gases are decreased at the last stage of blast refining, the damper operation reverse to that of the gas increasing period as mentioned above is carried out.

Next, a method for the control of time relative to the blast refining will be described. In control at the period I, the draught fan damper is restricted to reduce the intake amount, whereby increasing an unburnt portion in the exhaust gases. That is, the quantity of furnace generated gases is predicted as previously mentioned, and the resultant value and the preobtained formula between the draught fan damper, the dust collector damper and the flow rate of the exhaust gases are used to obtain opening of the damper to thereby set openings of the draught fan damper and the dust collector damper beforehand.

At the period II, the quantity of furnace generated gases is rapidly varied so that future variation in quantity of furnace generated gases resulting from charging of the secondary raw material is predicted and meanwhile, the dust collector damper is operated beforehand so as to obtain the quantity of drawn exhaust gases corresponding thereto. That is, controlling is made so as not to produce delay in actual variation, and at this period II, the draught fan damper is placed in fully open state so as to produce no harm in sucking the exhaust gases. Then, at the period III, the quantity of furnace generated gases is rich and stabilized so that controlling in principal consideration of the throat pressure can be made. Principally, the dust collector damper is independently controlled.

Next, at the period IV, when the quantity of oxygen fed is increased, further variation in quantity of furnace generated gases resulting from increase in quantity of oxygen fed is predicted with high accuracy, and the dust collector damper should be operated beforehand in accordance with the prediction attained. That is, at the period IV, employment of controlling principally based on the throat pressure control is not desirable since the blow-out phenomenon occurs. At the period V, the quantity of furnace generated gases is rapidly reduced, and hence, the same consideration as that of the period I is necessary. That is, controlling is made in consideration of surging of the draught fan damper and simultaneous controlling of the dust collector damper and the draught fan damper is made to vary the quantity of drawn exhaust gases.

In accordance with the abovementioned control, the quantity of drawn exhaust gases 22*a* comes very close to the quantity of furnaced generated gases 21 to produce no time lag and to minimise the aforementioned blow-out or intake phenomenon. It has been proved from a comparison in effect between the present invention and the prior art with respect to the recovered quantity of gases in standard calorific power in FIG. 11 that the recovered quantity of gases 28*a* in accordance with the present invention is materially great in the period I, period II, period IV, and period V, for example, such as seen from an increase in the recovered quantity reaching 10 $Nm^3T \cdot S$ in one example, as compared to the known constant throat pressure control not in accordance with the method of the present invention, which recovered quantity of gases is indicated at 28. In addition, according to the invention, electric power saving has been achieved, as for example, 0.3 KWH/T.S.

What is claimed is:

1. A method of recovering combustible gases exhausted during the operation of an oxygen blown converter, comprising the steps of:

(a) detecting a pressure differential between the hood of the converter and atmospheric pressure, comparing the detected pressure differential with a predetermined safe pressure differential to provide a steady-state exhaust gas damper control signal which maintains said safe pressure differential using the actual generated gases in the converter;

(b) detecting the quantity of oxygen fed to the converter, the quantity of raw material charged to the converter, the composition of the exhaust gases and the flow rate of the exhaust gases to provide a modified exhaust gas damper control signal which maintains said safe pressure differential based upon the expected generated gases in the converter;

(c) selecting said modified exhaust gas damper control signal during ingredient modification to the converter, and selecting said steady-state exhaust gas damper control signal during steady-state operation; and (d) adjusting the exhaust damper in the converter using the selected control signal, so as to reduce the loss of combustible gases.

* * * * *